US009668038B2

(12) United States Patent
Kaetel

(10) Patent No.: US 9,668,038 B2
(45) Date of Patent: May 30, 2017

(54) LOUDSPEAKER

(71) Applicant: Kaetel Systems GMBH, Munich (DE)

(72) Inventor: Klaus Kaetel, Munich (DE)

(73) Assignee: Kaetel Systems GMBH, Munich (DE)

( * ) Notice: Subject to any disclaimer, the term of this patent is extended or adjusted under 35 U.S.C. 154(b) by 0 days.

(21) Appl. No.: 14/040,561

(22) Filed: Sep. 27, 2013

(65) Prior Publication Data

US 2014/0105444 A1 Apr. 17, 2014

Related U.S. Application Data

(63) Continuation of application No. PCT/EP2012/055698, filed on Mar. 29, 2012.

(60) Provisional application No. 61/469,436, filed on Mar. 30, 2011.

(51) Int. Cl.

| | |
|---|---|
| ***H04R 1/02*** | (2006.01) |
| ***H04S 7/00*** | (2006.01) |
| ***H04R 5/02*** | (2006.01) |
| ***H04R 19/01*** | (2006.01) |
| ***H04R 1/24*** | (2006.01) |

(52) U.S. Cl.

CPC ..... *H04R 1/02* (2013.01); *H04R 1/025* (2013.01); *H04R 1/026* (2013.01); *H04R 1/24* (2013.01); *H04R 5/02* (2013.01); *H04R 19/016* (2013.01); *H04S 7/30* (2013.01); *H04S 2400/15* (2013.01)

(58) Field of Classification Search

CPC . H04R 1/02; H04R 1/026; H04R 5/02; H04R 19/016; H40R 1/025; H04S 7/30; H04S 2400/15

USPC ..... 381/386

See application file for complete search history.

(56) References Cited

U.S. PATENT DOCUMENTS

| | | | |
|---|---|---|---|
| 3,931,867 | A | 1/1976 | Janszen |
| 4,329,547 | A | 5/1982 | Imai |
| 4,357,490 | A | 11/1982 | Dickey |
| 4,580,654 | A | 4/1986 | Hale |
| 2005/0080616 | A1 | 4/2005 | Leung et al. |
| 2005/0163329 | A1 | 7/2005 | Dickey |

(Continued)

FOREIGN PATENT DOCUMENTS

| | | |
|---|---|---|
| DE | 19819452 | 1/2000 |
| GB | 832276 | 4/1960 |

(Continued)

OTHER PUBLICATIONS

Auld, Robert , "The Art of Recording the Big Band Pt. 1", URL:https://web.archive.org/web/20101111131107/http://www.auldworks.com/bbrec1. htm, Nov. 2011, 10 pages.

(Continued)

*Primary Examiner* — Duc Nguyen
*Assistant Examiner* — Sean H Nguyen
(74) *Attorney, Agent, or Firm* — Michael A. Glenn; Perkins Coie LLP

(57) ABSTRACT

A loudspeaker includes a longitudinal enclosure having at least one subwoofer speaker for emitting lower sound frequencies; a carrier portion on top of the longitudinal enclosure; and a speaker arrangement having individual speakers for emitting higher sound frequencies arranged in a different direction with respect to the longitudinal enclosure, wherein the speaker arrangement is fixed to the carrier portion and is not surrounded by the longitudinal enclosure.

15 Claims, 12 Drawing Sheets

(56) References Cited

U.S. PATENT DOCUMENTS

| | | | | |
|---|---|---|---|---|
| 2005/0220320 | A1* | 10/2005 | Kim et al. | 381/396 |
| 2006/0206221 | A1* | 9/2006 | Metcalf | 700/94 |
| 2006/0233402 | A1* | 10/2006 | Inagaki et al. | 381/182 |
| 2006/0262948 | A1 | 11/2006 | Metcalf | |
| 2007/0223734 | A1* | 9/2007 | Suzuki et al. | 381/96 |
| 2010/0098282 | A1 | 4/2010 | Shimura et al. | |
| 2010/0223552 | A1 | 9/2010 | Metcalf | |
| 2010/0223553 | A1 | 9/2010 | Madden | |
| 2011/0182449 | A1* | 7/2011 | Jenq | H04R 1/26 381/182 |
| 2012/0114147 | A1* | 5/2012 | Ohashi et al. | 381/182 |

FOREIGN PATENT DOCUMENTS

| | | |
|---|---|---|
| GB | 2063618 | 6/1981 |
| JP | 57148500 | 9/1982 |
| JP | 04216300 | 8/1992 |
| JP | 1127781 A | 5/1999 |
| WO | WO-9957936 | 11/1999 |
| WO | WO-2004032351 | 4/2004 |

OTHER PUBLICATIONS

"Convolution reverb", Wikipedia; retrieved online on Sep. 14, 2015 from url: https://web.archive.org/web/20100206213027/http://en.wikipedia.org/wiki/Convolution_reverb, Feb. 6, 2010, 2 pages.

Brusi, Jose (Joe) , "A Game of Numbers (Understanding Directivity Specifications)", Jan. 2010, pp. 1-7.

Buskin, Richard , "Green Day: 'Basket Case'", Sound on Sound (SOS), Feb. 2011, pp. 1-5.

* cited by examiner vented back-to-back 1st electret microphone arrangement

| $W_1$ | $W_2$ | charact. |
|---|---|---|
| 1 | 1 | sphere |
| -1 | -1 | sphere |
| 1 | -1 | 8 |
| -1 | 1 | 8 |
| $\neq 1$ | $\neq 1$ | kidney-like |

bandwidth: 60 kHz or 100 kHz

LOUDSPEAKER

CROSS-REFERENCE TO RELATED APPLICATIONS

This application is a continuation of copending International Application No. PCT/EP2012/055698, filed Mar. 29, 2012, which is incorporated herein by reference in its entirety, and additionally claims priority from U.S. Application No. 61/469,436, filed Mar. 30, 2011, which is also incorporated herein by reference in its entirety.

BACKGROUND OF THE INVENTION

The present invention is related to electroacoustics and, particularly to concepts of acquiring and rendering sound, loudspeakers and microphones.

Typically, audio scenes are captured using a set of microphones. Each microphone outputs a microphone signal. For an orchestra audio scene, for example, 25 microphones are used. Then, a sound engineer performs a mixing of the 25 microphone output signals into, for example, a standardized format such as a stereo format or a 5.1, 7.1, 7.2 etc., format. In a stereo format, the sound engineer or an automatic mixing process generates two stereo channels. For a 5.1 format, the mixing results in five channels and a subwoofer channel. Analogously, for example for a 7.2 format, the mixing results in seven channels and two subwoofer channels. When the audio scene is to be rendered in a reproduction environment, the mixing result is applied to electrodynamic loudspeakers. In a stereo reproduction set-up, two loudspeakers exist and the first loudspeaker receives the first stereo channel and the second loudspeaker receives the second stereo channel. In a 7.2 reproduction set-up, seven loudspeakers exist at predetermined locations and two subwoofers. The seven channels are applied to the corresponding loudspeakers and the two subwoofer channels are applied to the corresponding subwoofers.

The usage of a single microphone arrangement on the capturing side and a single loudspeaker arrangement on the reproduction side typically neglect the true nature of the sound sources.

For example, acoustic music instruments and the human voice can be distinguished with respect to the way in which the sound is generated and they can also be distinguished with respect their emitting characteristic.

Trumpets, trombones horns or bugles, for example, have a powerful, strongly directed sound emission. Stated differently, these instruments emit in an advantageous direction and, therefore, have a high directivity.

Violins, cellos, contrabasses, guitars, grand pianos, small pianos, gongs and similar acoustic musical instruments, for example, have a comparatively small directivity or a corresponding small emission quality factor Q. These instruments use so-called acoustic short-circuits when generating sounds. The acoustic short-circuit is generated by a communication of the front side and the backside of the corresponding vibrating area or surface.

Regarding the human voice, a medium emission quality factor exists. The air connection between mouth and nose causes an acoustic short-circuit.

String or bow instruments, xylophones, cymbals and triangles, for example, generate sound energy in a frequency range up to 100 kHz and, additionally, have a low emission directivity or a low emission quality factor. Specifically, the sound of a xylophone and a triangle are clearly identifiable instead of their low sound energy and their low quality factor even within a loud orchestra.

Hence, it becomes clear that the sound generation by the acoustical instruments or other instruments and the human voice is very different from instrument to instrument.

When generating sound energy, air molecules, for example two- and three-atomic gas molecules are stimulated. There are three different mechanisms responsible for the stimulation. Reference is made to German Patent DE 198 19 452 C1. These are summarized in FIG. 7. The first way is the translation. The translation describes the linear movement of the air molecules or atoms with reference to the molecule's center of gravity. The second way of stimulation is the rotation, where the air molecules or atoms rotate around the molecule's center of gravity. The center of gravity is indicated in FIG. 7 at 70. The third mechanism is the vibration mechanism, where the atoms of a molecule move back and forth in the direction to and from the center of gravity of the molecules.

Hence, the sound energy generated by acoustical music instruments and generated by the human voice is composed by an individual mixing ratio of translation, rotation and vibration.

In the straightforward electro acoustic science, the definition of the vector sound intensity only reflects the translation. Unfortunately, however, the complete description of the sound energy, where rotation and vibration are additionally acknowledged, is missing in straightforward electro acoustics.

However, the complete sound intensity is defined as a sum of the intensities stemming from translation, from rotation and vibration.

Furthermore, different sound sources have different sound emission characteristics. The sound emission generated by musical instruments and voices generates a sound field and the field reaches the listener in two ways. The first way is the direct sound, where the direct sound portion of the sound field allows a precise location of the sound source. The further component is the room-like emission. Sound energy emitted in all room directions generates a specific sound of instruments or a group of instruments since this room emission cooperates with the room by reflections, attenuations, etc. A characteristic of all acoustical musical instruments and the human voice is a certain relation between the direct sound portion and the room-like emitted sound portion.

SUMMARY

According to an embodiment, a loudspeaker may have: a longitudinal enclosure comprising at least one subwoofer speaker for emitting lower sound frequencies; a carrier portion on top of the longitudinal enclosure; and a speaker arrangement comprising individual speakers for emitting higher sound frequencies arranged in a different direction with respect to the longitudinal enclosure, wherein the speaker arrangement is fixed to the carrier portion and is not surrounded by the longitudinal enclosure.

According to another embodiment, a method of manufacturing a loudspeaker may have the steps of: fixing a carrier portion on top of a longitudinal enclosure comprising at least one subwoofer speaker for emitting lower sound frequencies; and fixing a speaker arrangement on top of the carrier portion, the speaker arrangement comprising individual speakers for emitting higher sound frequencies arranged in a different direction with respect to the longitudinal enclosure, wherein the speaker arrangement is fixed to the carrier portion and is not surrounded by the longitudinal enclosure.

The present invention is based on the finding that, for obtaining a very good sound by loudspeakers in a reproduction environment, which is comparable and in most instances even not discernable from the original sound scene, where the sound is not emitted by loudspeakers but by musical instruments or human voices, the different ways in which the sound intensity is generated, i.e., translation, rotation, vibration have to be considered or the different ways in which the sound is emitted, i.e., whether the sound is emitted as a direct sound or as a room-like emission, is to be accounted for when capturing an audio scene and rendering an audio scene. When capturing the audio scene, sound having a first or high directivity is acquired to obtain a first acquisition signal and, simultaneously, sound having a second directivity is acquired to obtain a second acquisition signal, where the directivity of the second acquisition signal or the directivity of the sound actually captured by the second acquisition signal is lower than the second directivity.

Thus, an audio scene is not described by a single set of microphones but is described by two different sets of microphone signals. These different sets of microphone signals are never mixed with each other. Instead, a mixing can be performed with the individual signals within the first acquisition signal to obtain a first mixed signal and, additionally, the individual signals contained in the second acquisition signal can also be mixed among themselves to obtain a second mixed signal. However, individual signals from the first acquisition signal are not combined with individual signals of the second acquisition signal in order to maintain the sound signals with the different directivities. These acquisition signals or mixed signals can be separately stored. Furthermore, when mixing is not performed, the acquisition signals are separately stored. Alternatively or additionally, the two acquisition signals or the two mixed signals are transmitted into a reproduction environment and rendered by individual loudspeaker arrangements. Hence, the first acquisition signal or the first mixed signal is rendered by a first loudspeaker arrangement having loudspeakers emitting with a higher directivity and the second acquisition signal or the second mixed signal is rendered by a second separate loudspeaker arrangement having a more omnidirectional emission characteristic, i.e., having a less directed emission characteristic.

Hence, a sound scene is represented not only by one acquisition signal or one mixed signal, but is represented by two acquisition signals or two mixed signals which are simultaneously acquired on the one hand or are simultaneously rendered on the other hand. The present invention ensures that different emission characteristics are additionally recorded from the audio scene and are rendered in the reproduction set-up.

Loudspeakers for reproducing the omnidirectional characteristic comprise, in an embodiment, a longitudinal enclosure comprising at least one subwoofer speaker for emitting lower sound frequencies. Furthermore, a carrier portion is provided on top of the cylindrical enclosure and a speaker arrangement comprises individual speakers for emitting higher sound frequencies that are arranged in different directions with respect to the cylindrical enclosure. The speaker arrangement is fixed to the carrier portion and is not surrounded by the longitudinal enclosure. In an embodiment, the cylindrical enclosure additionally comprises one or more individual speakers emitting with a high directivity. This can be done by placing these individual speakers within the cylindrical enclosure in a line-array, where the loudspeaker is arranged with respect to the listener so that the directly emitting loudspeakers are facing the listeners. Furthermore, it is advantageous that the carrier portion is a cone or frustum-like element having a small cross-section area on top where the speaker arrangement is placed. This makes sure that the loudspeaker has improved characteristics with respect to the perceived sound due to the fact that the coupling between the longitudinal enclosure in which the subwoofer is arranged and the speaker arrangement for generating the omnidirectional sound is restricted to a comparatively small area. Furthermore, it is advantageous that the speaker arrangement is made up by a ball-like element which has equally distributed loudspeakers in it where the individual loudspeakers, however, are not included in the casing but are freely-vibratable membranes supported by a supporting structure. This makes sure that the omnidirectional emission characteristic is additionally supported by a good rotational portion of sound since such individual speakers, which are not cased in a casing, additionally generate a significant amount of rotational energy.

Additionally, the capturing of the sound scene can be enhanced by using specific microphones comprising a first electrode microphone portion and a second electret microphone portion which are arranged in a back-to-back arrangement. Both electret microphone portions comprise a free space so that a sound acquisition membrane or foil is movable. A vent channel is provided for venting the first free space or the second free space to the ambient pressure so that both microphones, although arranged in the back-to-back arrangement, have superior sound acquisition characteristics. Furthermore, first contacts for deriving an electrical signal are arranged at the first microphone portion and second contacts for deriving an electrical signal are arranged at the second microphone portion. Due to the back-to-back arrangement, it is advantageous that the ground contact, i.e., the counter-electrode contact of both microphones, is connected or implemented as a single contact so that the microphone comprises three output contacts for deriving two different voltages as electrical signals. Advantageously, each microphone portion is comprised of a metalized foil as a first electrode which is movable in response to sound energy impinging on the microphone, a spacer and a counter electrode which has, on its top, an electret foil. Each counter electrode additionally comprises venting channel portions which are vertically arranged with respect to the microphone. Furthermore, the venting channel comprises a horizontal venting channel portion communicating with the vertical venting channel portions and the vertical and horizontal venting channel portions are applied to the first and second microphone portions in such a way that both free spaces of the microphone portions defined by the corresponding spacers are vented to the ambient pressure and are, therefore, at ambient pressure. Additionally, this makes sure that the sound acquisition electrode can freely move with respect to the corresponding counter electrode since the venting makes sure that the free space does not build up an additional counter-pressure in addition to the ambient pressure.

BRIEF DESCRIPTION OF THE DRAWINGS

Embodiments of the present invention will be detailed subsequently referring to the appended drawings, in which.

DETAILED DESCRIPTION OF THE INVENTION

Figure 2:
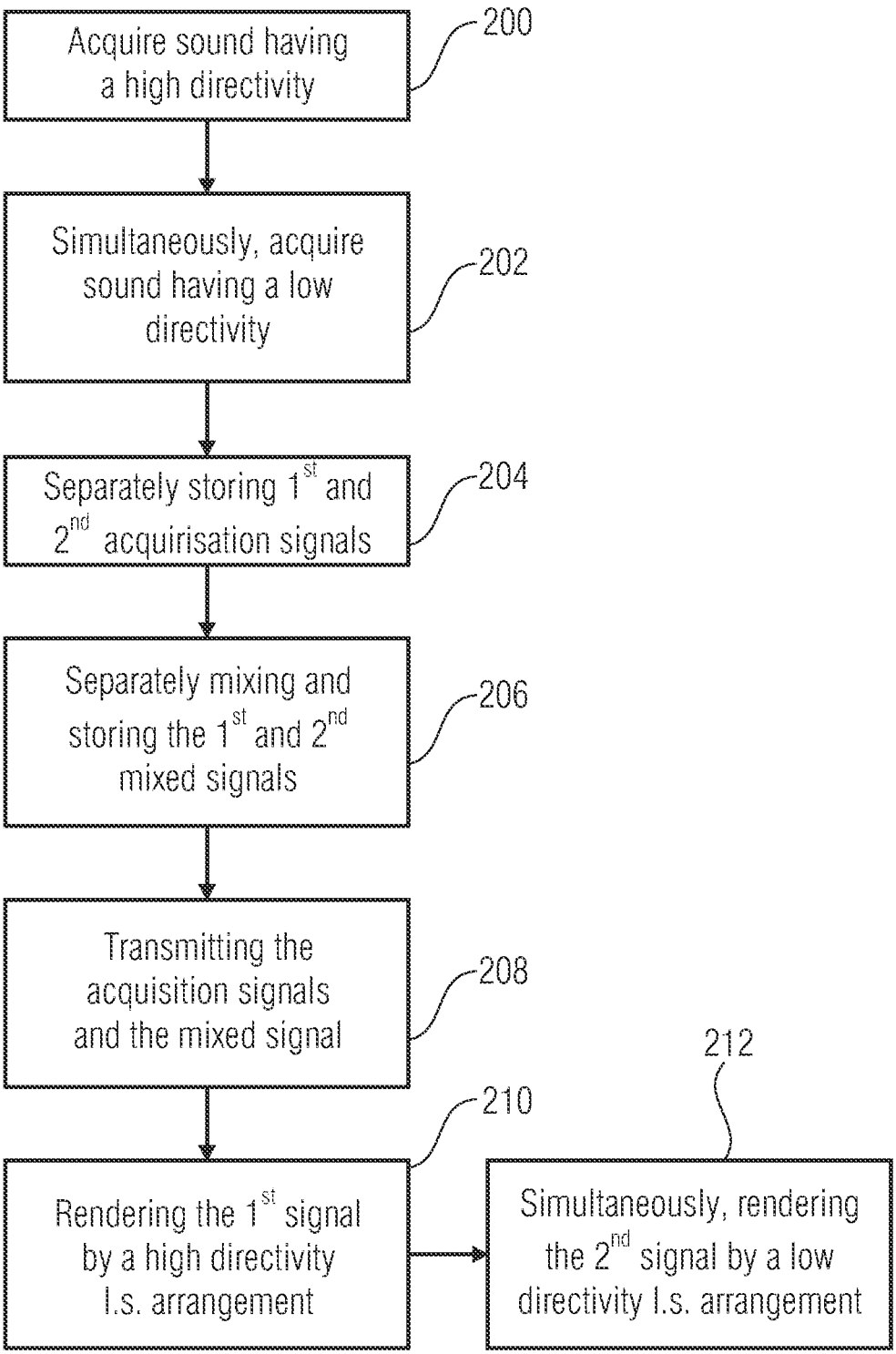
FIG. 2 illustrates a flow chart for illustrating the method of capturing an audio scene or rendering an audio scene.

FIG. 2 illustrates a flow chart of a method of capturing an audio scene. In step 200, a sound having a first directivity is acquired to obtain a first acquisition signal. In step 202, a sound having a second directivity is acquired to obtain a second acquisition signal. Particularly, the first directivity is higher than the second directivity. Furthermore, the steps 200, 202 of acquiring are performed simultaneously, wherein both acquisition signals generated by step 200 and 202 together represent the audio scene. In step 204, the first and second acquisition signals are separately stored for later use either for mixing or reproduction or transmission. Alternatively or additionally, step 206 is performed, wherein individual channels in the first acquisition signal are mixed to obtain a first mixed signal and where individual channels in the second acquisition signal are mixed to obtain a second mixed signal. Both mixed signals can then be separately stored at the end of step 206. Alternatively or additionally, the acquisition signals generated by steps 200, 202 or the mixed signals generated by step 206 can be transmitted to a loudspeaker setup as indicated in block 208. In step 210, the first mixed signal or the first acquisition signal is rendered by a loudspeaker arrangement having a first directivity where the first directivity is a high directivity. In step 212, the second acquisition signal or second mixed signal is rendered by a second loudspeaker arrangement having a second directivity, where the second directivity is lower than the first directivity and where the steps 210, 212 are performed simultaneously.

Figure 1A:
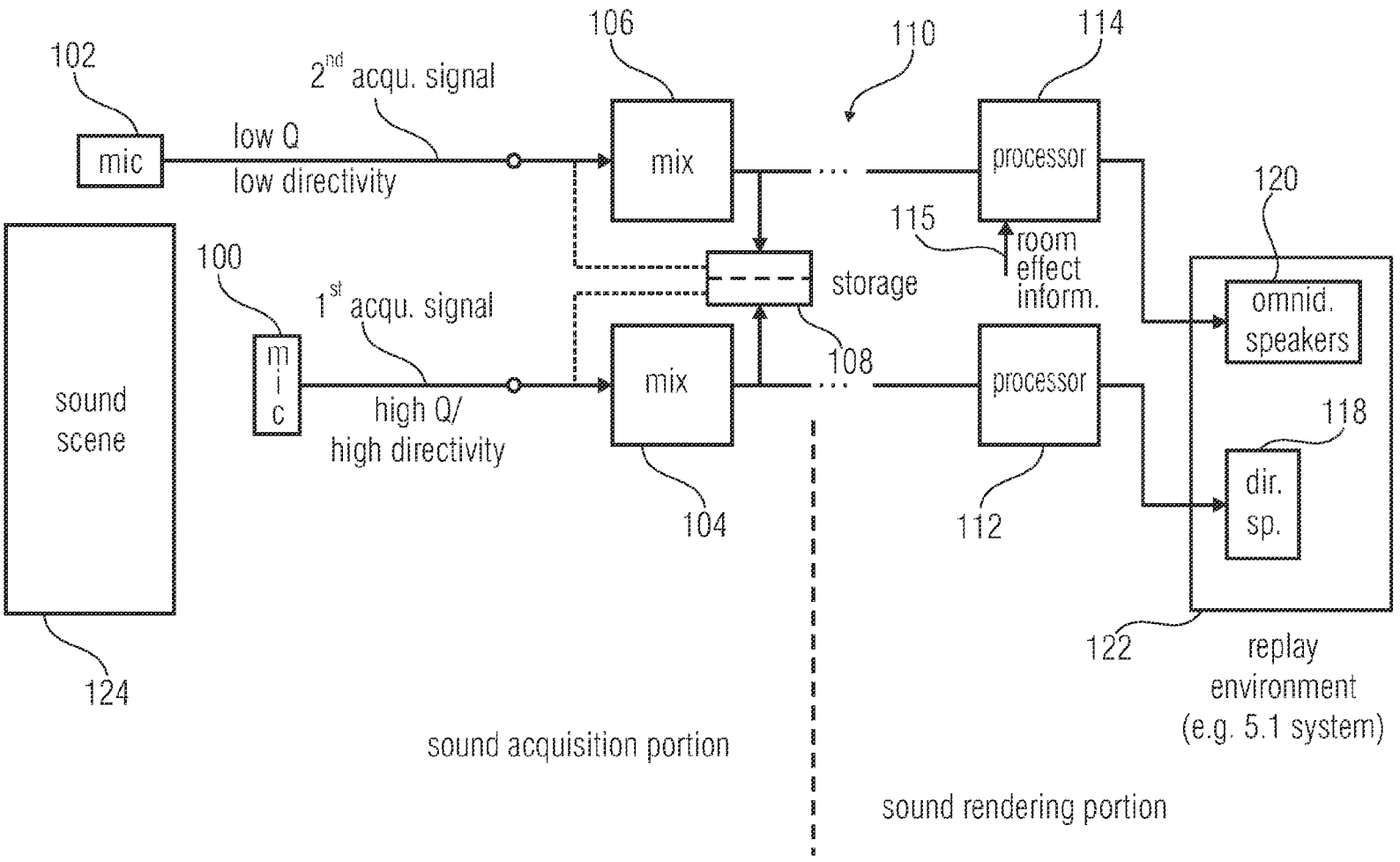
FIG. 1A illustrates a schematic representation of the sound acquisition scenario and a sound rendering scenario.

In an embodiment, the step of acquiring the sound having a first directivity comprises placing microphones 100 illustrated in FIG. 1A between places for sound sources and places for listeners and the microphones indicated at 100 in FIG. 1A form a first set of microphones. The individual microphone signals output by the individual microphones 100 form the first acquisition signal. Furthermore, the step 202 of FIG. 2 comprises placing a second set of microphones 102 lateral or above places for sound sources as schematically illustrated in FIG. 1A, where the microphones 102 are placed above the sound scene while microphones 100 are placed in front of the sound scene. The individual microphone signals generated by the set of microphones 102 together form the second acquisition signal. The setup illustrated in FIG. 1A additionally comprises a first mixer 104, a second mixer 106, a storage 108, a transmission channel 110. The left portion of FIG. 1A until the transmission channel 110 represents the sound acquisition portion. In the sound rendering portion illustrated at the left hand portion of FIG. 1A, a first processor 112 receiving the first acquisition signal or the first mixed signal is provided. Additionally, a second processor 114 receiving the second acquisition signal or the second mixed signal is provided. The first processor 112 feeds the first speaker arrangement 118 for a directed sound emission and the second processor 114 feeds the second speaker arrangement 120 for an omnidirectional sound emission. Both loudspeaker arrangements are positioned in a replay environment 122 while the microphones 102, 100 are placed close to a sound scene 124 or can also be placed within the sound scene 124.

Figure 1B:
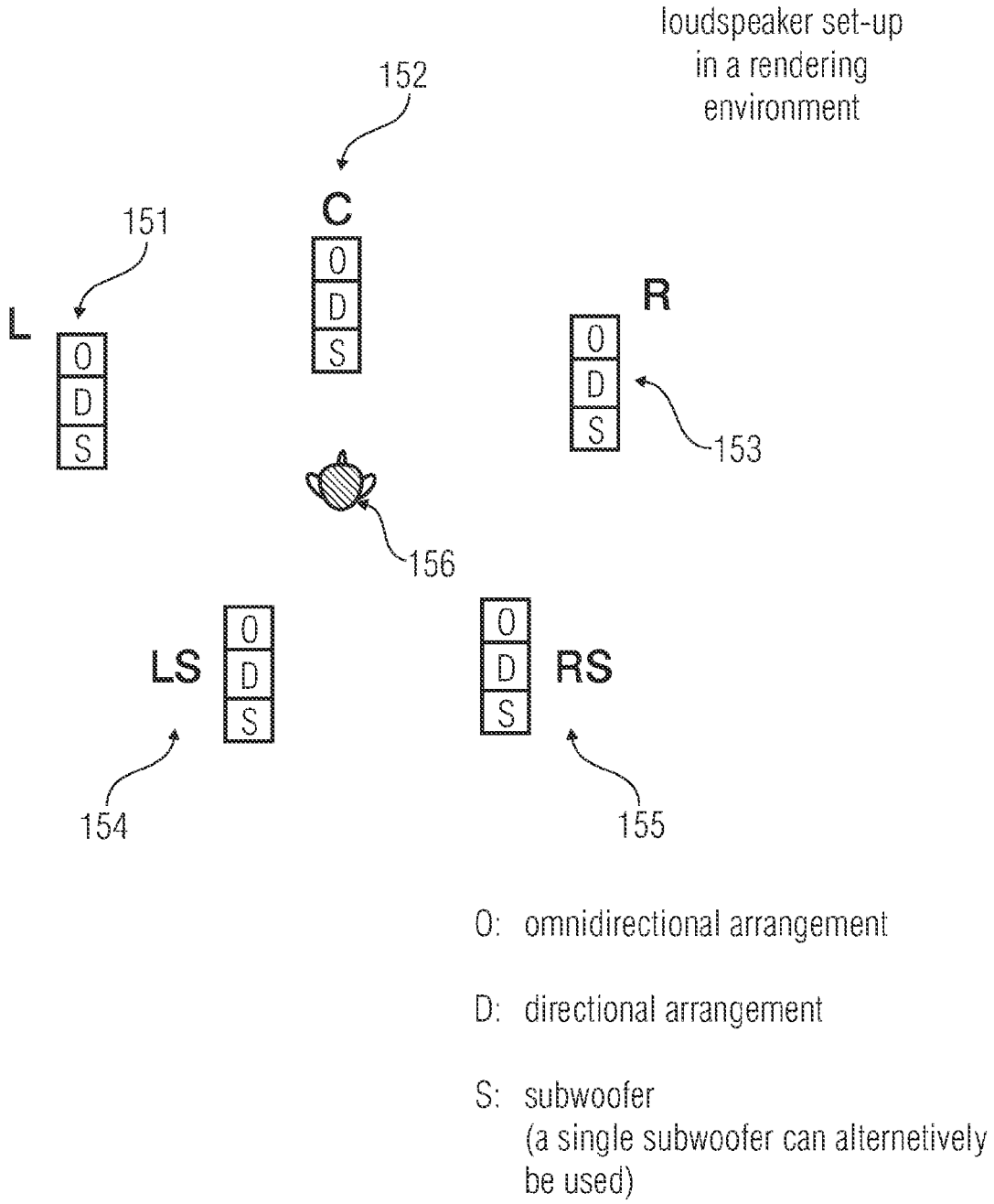
FIG. 1B illustrates a loudspeaker placement in an exemplary standardized reproduction set-up with omnidirectional, directional and subwoofer speaker arrangements.

FIG. 1B illustrates an exemplary standardized loudspeaker set-up in a replay environment (122 in FIG. 1A). A five-channel environment similar to Dolby surround or MPEG surround is indicated where there is a left loudspeaker 151, a center loudspeaker 152, a right loudspeaker 153, a left surround loudspeaker 154 and a right surround loudspeaker 155. The individual loudspeakers are arranged at standardized places as, for example, known from ISO/IEC standardization of different loudspeaker setups such as stereo setups, 5.1 setups, 7.1 setups, 7.2 setups, etc.

As indicated in FIG. 1B, each of the individual loudspeakers 151 to 155 comprises an omnidirectional arrangement, a directional arrangement and a subwoofer, although a single subwoofer would also be useful. In this embodiment each of the loudspeakers 151 to 155 would only have an omnidirectional arrangement and a directional arrangement and there would be an additional subwoofer placed somewhere in the room and advantageously placed close to the center speaker. A listener position is indicated in FIG. 1B at 156.

The sound acquisition concept illustrated in FIGS. 1A, 1B and 2 can also be described as the "dual Q" concept which is an electro acoustic transmission concept in which the sound energy portions of individual sound sources or a complete sound scene are separately acquired with respect to a sound energy emitted in the direction of the listener on the one hand and a sound energy emitted more or less omnidirectional into the room of the sound scene. Furthermore, these different signals generated by the different microphone arrays are then separately processed and separately rendered.

When an orchestra is considered, it has been found that the sound energy which is emitted directly in the front direction to the listener is composed mainly of instruments having a high directivity such as trumpets or trombones and, additionally, comes from the singers or vocalists. This "high Q" sound portion is detected by microphones 100 of FIG. 1A which are placed between the sound sources and the listeners and which are directed in the direction of the sound sources if these microphones are microphones having a certain acquisition directivity. It is to be noted here that microphones 100 can be omnidirectional or directed microphones. Directed microphones are advantageous where the maximum acquisition sensitivity is directed to the sound scene or individual instruments within the sound scene. However, already due to the placement of the first set of microphones 100 between the sound scene and the listener, a directed sound energy is acquired even though omnidirectional microphones are used.

Instruments having a high directivity but which do not directly emit sound in the front direction such as a tuba, different horns or wings and several wood wind instruments and, additionally, instruments having a low directivity such as string instruments, percussion, gong or triangle generate a room-like or less directed sound emission. This "low Q" sound portion is detected with a microphone set placed lateral and/or above the instruments or with respect to the sound scene. If microphones having a certain directivity are used, it is advantageous that these microphones are directed into the direction of the individual sound sources such as tuba, horns, wood wind instruments, strings, percussion, gong, triangle.

These individual "high Q" and "low Q" microphone signals, i.e., the first and second acquisition signals are independently recorded from each other and further processed such as mixed, stored, transmitted or in other ways manipulated. Hence, separate high and low Q mixtures can be mixed to obtain the first and second mixed signals and these mixed signals can be stored within the storage 108 or can be rendered via separate high and low Q speakers.

Dual Q loudspeaker systems illustrated in FIG. 1B have separate speaker arrangements for the high Q rendering and the low Q rendering. The purpose of the high Q speakers is a direct sound emission directed to the ears of the listeners while the low Q speaker arrangement should care for an omnidirectional sound emission within the room as far as possible. Therefore, directed sphere emitters or cylinder wave emitters are used for the high Q rendering. For the low Q rendering, omnidirectionally emitting speakers are used, where the omnidirectional characteristic actually provided by the individual speaker arrangements will typically not be an ideal omnidirectional characteristic but at least an approximation to this. Stated differently, the speakers for the low Q rendering should have a reproduction characteristic which is less directed than the reproduction or emission characteristic of the high Q speaker arrangement.

Furthermore, as indicated at 115 in FIG. 1A, it is advantageous in an embodiment to introduce room effect information into the processor 114 for the reproduction of the low Q sound. For the generation of virtual room effects within the replay environment or replay room, each individual speaker within the omnidirectional arrangement receives a separate signal representing the room effect information and a convolution or folding of the corresponding low Q signal with the corresponding effect signal is performed. On the other hand, the processor 112 does not receive any room effect information so that a room effect processing is not performed with the first acquisition signal or first mixed signal but is only advantageous with the second acquisition signal or the second mixed signal.

Advantageously, the dual Q technology is combined with the icon technology which is described in the context of FIGS. 3 to 7. The icon technology describes an electro acoustic concept in which the sound energy generated by sound sources, specifically acoustical musical instruments and the human voice, is reproduced not only in the form of translation but also in the form of rotation and vibration of air or gas molecules or atoms. Advantageously, translation, rotation and vibration are detected, transmitted and reproduced.

Subsequently, FIG. 1A is discussed in more detail. Each microphone set 100, 102 advantageously comprises a number of microphones being, for example, higher than 10 and even higher than 20 individual microphones. Hence, the first acquisition signal and the second acquisition signal each comprises 10 or 20 or more individual microphone signals. These microphone signals are then typically downmixed within the mixer 104, 106, respectively to obtain a mixed signal having a corresponding lower number of individual signals. When, for example, the first acquisition signal has 20 individual signals and the mixed signal has 5 individual signals, then each mixer performs a downmix from 20 to 5. However, when the number of microphones is smaller than the number of speaker places then the mixers 104, 106 can also perform an upmix or when the number of microphones in a microphone set is equal to the number of loudspeakers, then no mixing at all or the mixing among the microphone signals from 1 set of microphones can be performed but the mixing does not influence the number of individual signals.

Furthermore, instead of or in addition to placing the microphones 102 above or lateral to the sound scene and placing the microphones 100 in front of the sound scene, microphones can also be placed selectively in a corresponding proximity to the corresponding instruments.

When the audio scene, for example, comprises an orchestra having a first set of instruments emitting with a higher directivity and a second set of instruments emitting sound with a lower directivity, then the step of acquiring comprises placing the first set of microphones closer to the instruments of the first set of instruments than to the instruments of the second set of instruments to obtain the first acquisition signal and placing the second set of microphones closer to the instruments of the second set of instruments, i.e., the low directivity emitting instruments, than to the first set of instruments to obtain the second acquisition signal.

Depending on the implementation, the directivity as defined by a directivity factor related to a sound source is the ratio of radiated sound intensity at the remote point on the principle axis of a sound source to the average intensity of the sound transmitted through a sphere passing through the remote point and concentric with the sound source. Advantageously, the frequency is stated so that the directivity factor is obtained for individual subbands.

Regarding a sound acquisition by microphones, the directivity factor is the ratio of the square of the voltage produced by sound waves arriving parallel to the principle axis of a microphone or other receiving transducer to the mean square of the voltage that would be produced if sound waves having the same frequency and mean square pressure where arriving simultaneously from all directions with random phase. Advantageously, the frequency is stated in order to have a directivity factor for each individual subband.

Regarding sound emitters such as speakers, the directivity factor is the ratio of radiated sound intensity at the remote point on the principle axis of a loudspeaker or other transducer to the average intensity of the sound transmitted through a sphere passing through the remote point and concentric with the transducer. Advantageously, the frequency is given as well in this case.

However, other definitions exist for the directivity factor as well which all have the same characteristic but result in different quantitative results. For example, for a sound emitter, the directivity factor is a number indicating the factor by which the radiated power would have to be increased if the directed emitter were replaced by an isotopic radiator assuming the sane field intensity for the actual sound source and the isotropic radiator.

For the receiving case, i.e., for a microphone, the directivity factor is a number indicating the factor by which the input power of the receiver/microphone for the direction of maximum reception exceeds the mean power obtained by averaging the power received from all directions of reception if the field intensity at the microphone location is equal for any direction of wave incidence.

The directivity factor is a quantitative characterization of the capacity of a sound source to concentrate the radiated energy in a given direction or the capacity of a microphone to select signals incident from a given direction.

When the measure of the directivity factor is from 0 to 1, then the directivity factor related to the first acquisition signal is advantageously greater than 0.6 and the directivity factor related to the second acquisition is advantageously lower than 0.4. Stated differently, it is advantageous to place the two different sets of microphones so that the values of 0.6 for the first acquisition signal and 0.4 for the second acquisition signal is obtained. Naturally, it will practically not be possible to have a first acquisition signal only having directed sound and not having any omnidirectional sound. On the other hand, it will not be possible to have a second acquisition signal only having omnidirectionally emitted sound and not having directionally emitted sound. However, the microphones are manufactured and placed in such a way that the directionally emitted sound dominates the omnidirectionally emitted sound in the first microphone signal and that the omnidirectionally emitted sound dominates over the directionally emitted sound in the second acquisition signal.

A method of rendering an audio scene comprises a step of providing a first acquisition signal related to sound having a first directivity or providing a first mixed signal related to sound having the first directivity. The method of rendering additionally comprises providing a second acquisition signal related to sound having a second directivity or providing a second mixed signal related to sound having a second directivity, where the first directivity is higher than the second directivity. The steps of providing can be actually implemented by receiving, in the sound rendering portion of FIG. 1A, a transmitted acquisition signal or a transmitted mixed signal or by reading, from a storage, the first acquisition signal or the first mixed signal on the one hand, and the second acquisition signal or the second mixed signal on the other hand.

Furthermore, the method of rendering comprises a step of generating (210, 212) a sound signal from the first acquisition signal or the first mixed signal and the step of generating a second sound signal from the second acquisition signal or the second mixed signal. For generating the first sound signal a directional speaker arrangement 118 is used, and for generating the second signal an omnidirectional speaker arrangement 120 is used. Advantageously, the directivity of the directional speaker arrangement is higher than the directivity of the omnidirectional speaker arrangement 120, although it is clear that an ideal omnidirectional emission characteristic can almost not be generated by existing loudspeaker systems, although the loudspeaker of FIGS. 3 to 6 provides an excellent approximation of an ideal omnidirectional loudspeaker emission characteristic.

Advantageously, the emission characteristic of the omnidirectional speakers is close to the ideal omnidirectional characteristic within a tolerance of 30%.

Subsequently, reference is made to FIGS. 3 to 7 for illustrating a sound rendering and a loudspeaker.

For example, brass instruments are instruments with a mainly translatory sound generation. The human voice generates a translatorial and a rotational portion of the air molecules. For the transmission of the translation, existing microphones and speakers with piston-like operating membranes and a back enclosure are available.

The rotation is generated mainly by playing bow instruments, guitar, a gong or a piano due to the acoustic short-circuit of the corresponding instrument. The acoustic short-circuit is, for example, performed via the F-holes of a violin, the sound hole for the guitar or between the upper and lower surface of the sounding board at a grand or normal piano or by the front and back phase of a gong. When generating a human voice, the rotation is excited between mouth and nose. The rotation movement is typically limited to the medium sound frequencies and can be acquired by microphones having a figure of eight characteristic, since these microphones additionally have an acoustic short-circuit. The reproduction is realized by mid-frequency speakers with freely vibratable membranes without having a backside enclosure.

The vibration is generated by violins or is strongly generated by xylophones, cymbals and triangles. The vibrations of the atoms within a molecule is generation up to the ultrasound region above 60 kHz and even up to 100 kHz.

Although this frequency range is typically not perceivable by the human hearing mechanism, nevertheless level and frequency-dependent demodulations effects and other effects take place, which are then made perceivable, since they actually occur within the hearing range extending between 20 Hz and 20 kHz. The authentic transmission of vibration is available by extending the frequency range above the hearing limit at about 20 kHz up to more than 60 or even 100 kHz.

The detection of the directional sound portion for a correct location of sound sources necessitates a directional microphoning and speakers with a high emission quality factor or directivity in order to only put sound to the ears of the listeners as far as possible. For the directional sound, a separate mixing is generated and reproduced via separate speakers.

The detection of the room-like energy is realized by a microphone setup placed above or lateral with respect to the sound sources. For the transmission of the room-like portion, a separate mixing is generated and reproduced by speakers having a low emission quality factor (sphere emitters) in a separate manner.

Figure 3:
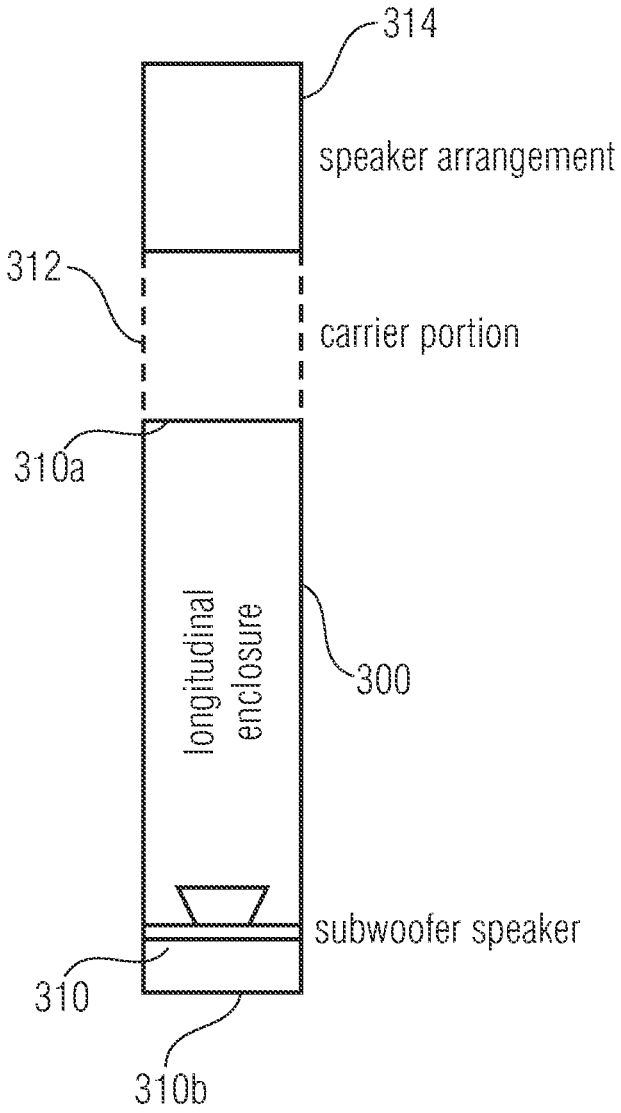
FIG. 3 illustrates a schematic representation of a loudspeaker.
Figure 4:
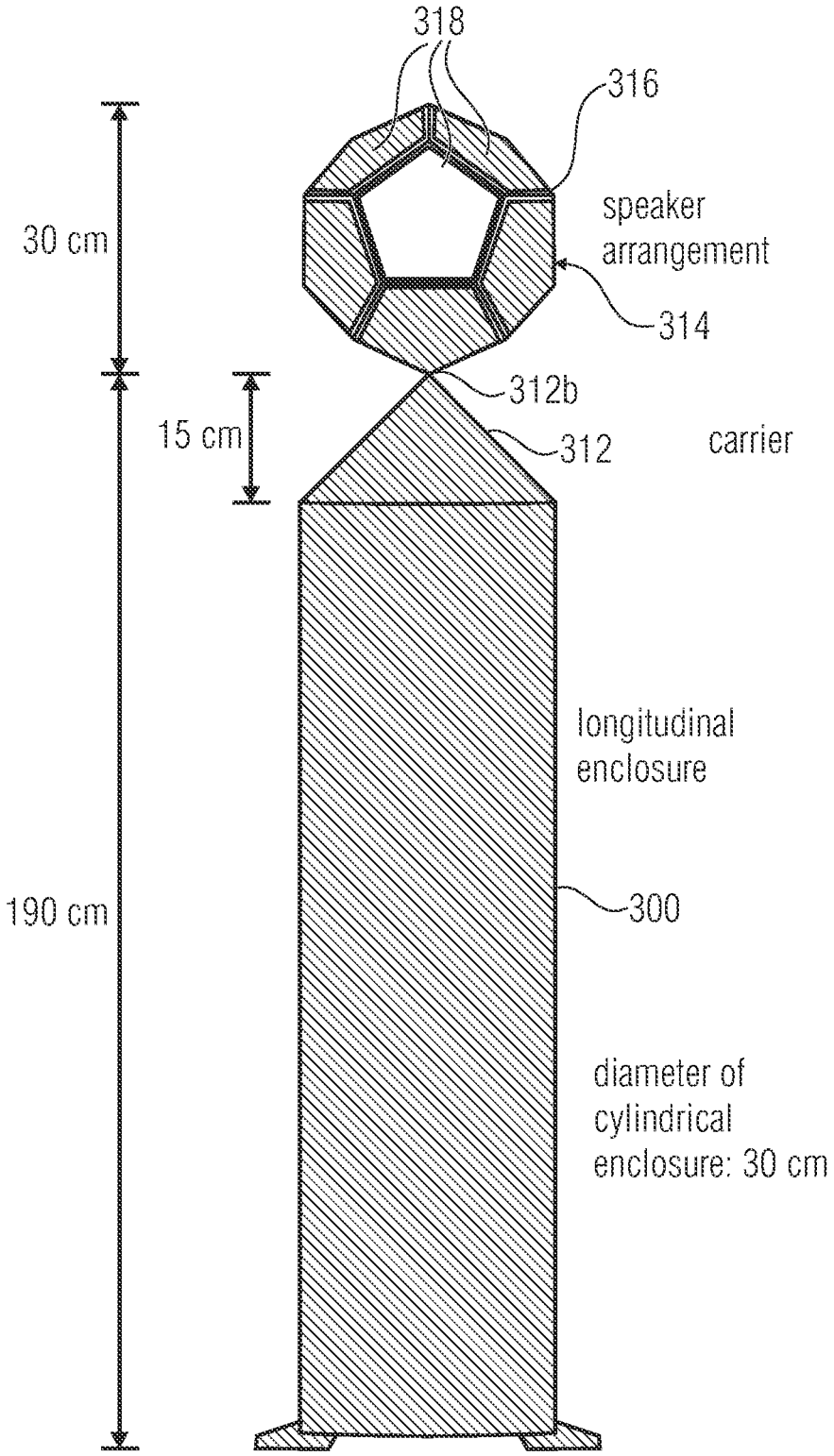
FIG. 4 illustrates an embodiment of a loudspeaker.

Subsequently, a loudspeaker is described with respect to FIG. 3. The loudspeaker comprises a longitudinal enclosure 300 comprising at least one subwoofer speaker 310 for emitting lower sound frequencies. Furthermore, a carrier portion 312 is provided on a top and 310*a* of the longitudinal enclosure. Furthermore, the longitudinal enclosures has a bottom end 310*b* and the longitudinal enclosure is advantageously closed throughout its shape and is particularly closed by a bottom plate 310*b* and the upper plate 310*a*, in which the carrier portion 312 is provided. Furthermore, an omnidirectionally emitting speaker arrangement 314 is provided which comprises individual speakers for emitting higher sound frequencies which are arranged in different directions with respect to this longitudinal enclosure 300, wherein the speaker arrangement is fixed to the carrier portion 312 and is not surrounded by the longitudinal enclosure 300 as illustrated. Advantageously, the longitudinal enclosure is a cylindrical enclosure with a circle as a diameter throughout the length of the cylindrical enclosure 300. Advantageously, the longitudinal enclosure has a length greater than 50 cm or 100 cm and a lateral dimension grater than 20 cm. As illustrated in FIG. 4, an advantageous dimension of the longitudinal enclosure is 175 cm, the diameter is 30 cm and the dimension of the carrier in the direction of the longitudinal enclosure is 15 cm and the speaker arrangement 314 is in a wall-shape manner and has a diameter of 30 cm, which is the same as the diameter of the longitudinal enclosure. The carrier portion 312 advantageously comprises a base portion having matching dimensions with the longitudinal enclosure 300. Therefore, when the longitudinal enclosure is a round cylinder, then the base portion of the carrier is a circle matching with the diameter of the longitudinal enclosure. However, when the longitudinal enclosure is square-shaped, then the lower portion of the carrier 312 is square-shaped as well and matches in dimensions with the longitudinal enclosure 300.

Furthermore, the carrier 312 comprises a tip portion having a cross-sectional area which is less than 20% of a cross-sectional area of the base portion, where the speaker arrangement 314 is fixed to the tip portion. Advantageously, as illustrated in FIG. 4, the carrier 312 is cone-shaped so that the entire loudspeaker illustrated in FIG. 4 looks like a pencil having a ball on top. This is advantageous due to the fact that the connection between the omnidirectional speaker arrangement 314 and the subwoofer-provided enclosure is as small as possible, since only the tip portion 312*b* of the carrier is in contact with the speaker arrangement 314. Hence, there is a good sound decoupling between the speaker arrangement and the longitudinal enclosure. Furthermore, it is advantageous to place the longitudinal enclosure below the speaker arrangement, since the omnidirectional emission is even better when it takes place from above rather than below the longitudinal enclosure.

Figure 5:
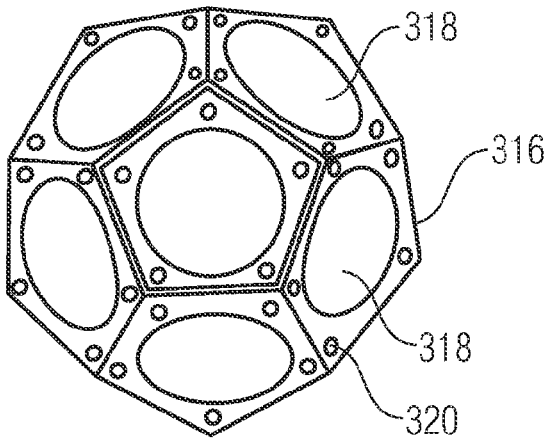
FIG. 5 illustrates an implementation of the omnidirectional emitting speaker arrangement.

The speaker arrangement 314 has a sphere-like carrier structure 316, which is also illustrated in FIG. 5 for a further embodiment. Individual loudspeakers are mounted so that each individual loudspeaker emits in a different direction. In order to illustrate the carrier structure 316, FIG. 4 illustrates several planes, where each plane is directed into a different direction and each plane represents a single speaker with a membrane such as a straightforward piston-like speaker, but without any back casing for this speaker. The carrier structure can be implemented specifically as illustrated in FIG. 5 where, again, the speaker rooms or planes 318 are illustrated. Furthermore, it is advantageous that the structure as illustrated in FIG. 5 additionally comprises many holes 320 so that the carrier structure 360 only fulfills its functionality as a carrier structure, but does not influence the sound emission and particularly does not hinder that the membranes of the individual speakers in the speaker arrangement 314 are freely suspended. Then, due to the fact that freely suspended membranes generate a good rotation component, a useful and high quality rendering of rotational sound can be produced. Therefore, the carrier structure is as less bulky as possible so that it only fulfills its functionality of structurally supporting the individual piston-like speakers without influencing the possibility of excursions of the individual membranes.

Advantageously, the speaker arrangement comprises at least six individual speakers and particularly even twelve individual speakers arranged in twelve different directions, where, in this embodiment, the speaker arrangement 314 comprises a pentagonal dodekaeder (e.g. body with 12 equally distributed surfaces) having twelve individual areas, wherein each individual area is provided with an individual speaker membrane. Importantly, the loudspeaker arrangement 314 does not comprise a loudspeaker enclosure and the individual speakers are held by the supporting structure 316 so that the membranes of the individual speakers are freely suspended.

Figure 6:
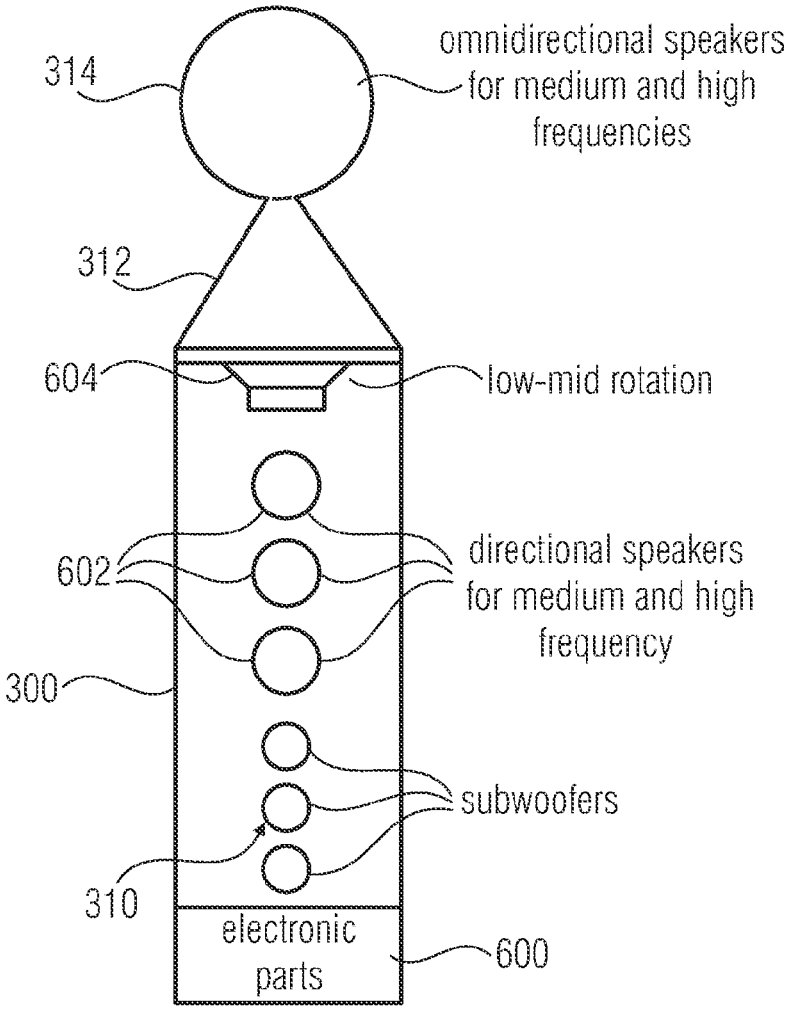
FIG. 6 illustrates a further schematic representation of the loudspeaker additionally having directionally emitting speakers.
Figure 7:
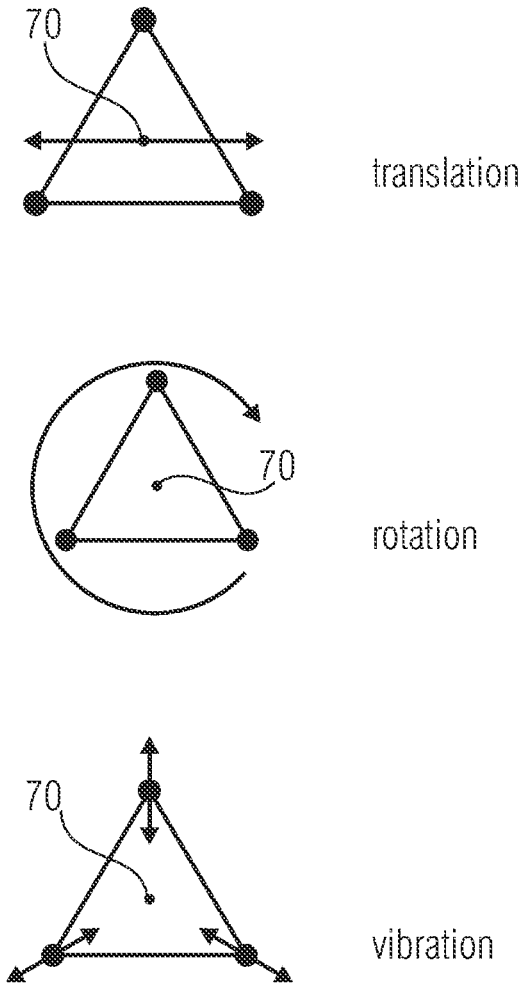
FIG. 7 illustrates the different sound intensities.

Furthermore, as illustrated in FIG. 6 in a further embodiment, the longitudinal enclosure 300 not only comprises the subwoofer, but additionally comprises electronic parts necessitated for feeding the subwoofer speaker and the speakers of the speaker arrangement 314. Additionally, in order to provide the speaker system as, for example, illustrated in FIG. 1B, the longitudinal enclosure 300 not only comprises a single subwoofer. Instead, one or more subwoofer speakers can be provided in the front of the enclosure, where the enclosure has openings indicated at 310 in FIG. 6, which can be covered by any kind of covering materials such as a foam-like foil or so. The whole volume of the closed enclosure serves as a resonance body for the subwoofer speakers. The enclosure additionally comprises one or more directional speakers for medium and/or high frequencies indicated at 602 in FIG. 6, which are advantageously aligned with the one or more subwoofers indicated at 310 in FIG. 6. These directional speakers are arranged in the longitudinal enclosure 300 and if there is more than one such speaker, then these speakers are advantageously arranged in a line as illustrated in FIG. 6 and the entire loudspeaker is arranged with respect to the listener so that the speakers 602 are facing the listeners. Then, the individual speakers in the speaker arrangement 314 are provided with the second acquisition signal or second mixed signal discussed in the context of FIG. 1 and FIG. 2, and the directional speakers are provided with the corresponding first acquisition signal or first mixed signal. Hence, when there are five speakers illustrated in FIG. 6 positioned at the five places indicated in FIG. 1B, then the situation in FIG. 1B exists where each individual speaker has an omnidirectional arrangement (316), a directional arrangement (602) and a subwoofer 310. If, for example, the first mixed signal comprises five channels, the second mixed signal comprises five channels as well and there is additionally provided one subwoofer channel, then each subwoofer 310 of the five speakers in FIG. 1B receives the same signal, each of the directional speakers 602 in one loudspeaker receives the corresponding individual signal of the first mixed signal, and each of the individual speakers in speaker arrangement 314 receives the corresponding same individual signal of the second mixed signal. Advantageously, the three speakers 602 are arranged in an d'Appolito arrangement, i.e., the upper and the lower speakers are mid frequency speakers and the speaker in the middle is a high frequency speaker.

Alternatively, however, the loudspeaker in FIG. 6 without the directional speaker 602 can be used in order to implement the omnidirectional arrangement in FIG. 1B for each loudspeaker place and an additional directional speaker can be placed, for example, close to the center position only or close to each loudspeaker position in order to reproduce the high directivity sound separately from the low directivity sound.

The enclosure furthermore comprises a further speaker 604 which is suspended at an upper portion of the enclosure and which has a freely suspended membrane. This speaker is a low/mid speaker for a low/mid frequency range between 80 and 300 Hz and advantageously between 100 and 300 Hz. This additional speaker is advantageous, since—due to the freely suspended membrane—the speaker generates rotation stimulation/energy in the low/mid frequency range. This rotation enhances the rotation generated by the speakers 314 at low/mid frequencies. This speaker 604 receives the low/mid frequency portion of the signal provided to the speakers at 314, e.g., the second acquisition signal or the second mixed signal.

In an embodiment with a single subwoofer, the subwoofer is a twelve inch subwoofer in the closed longitudinal enclosure 300 and the speaker arrangement 314 is a pentagon dodekaeder medium/high speaker arrangement with freely vibratable medium frequency membranes.

Additionally, a method of manufacturing a loudspeaker comprises the production and/or provision of the enclosure, the carrier portion and the speaker arrangement, where the carrier portion is placed on top of the longitudinal enclosure and the speaker arrangement with the individual speakers is placed on top of the carrier portion or alternatively the speaker arrangement without the individual speakers is placed on top of the carrier portion and then the individual speakers are mounted.

Subsequently, reference is made to FIGS. 9 to 12 in order to illustrate a microphone which can be advantageously used within the first or second microphone set illustrated in FIG. 1A at 110 or 100, or which can be used for any other microphone purpose.

Figure 8:
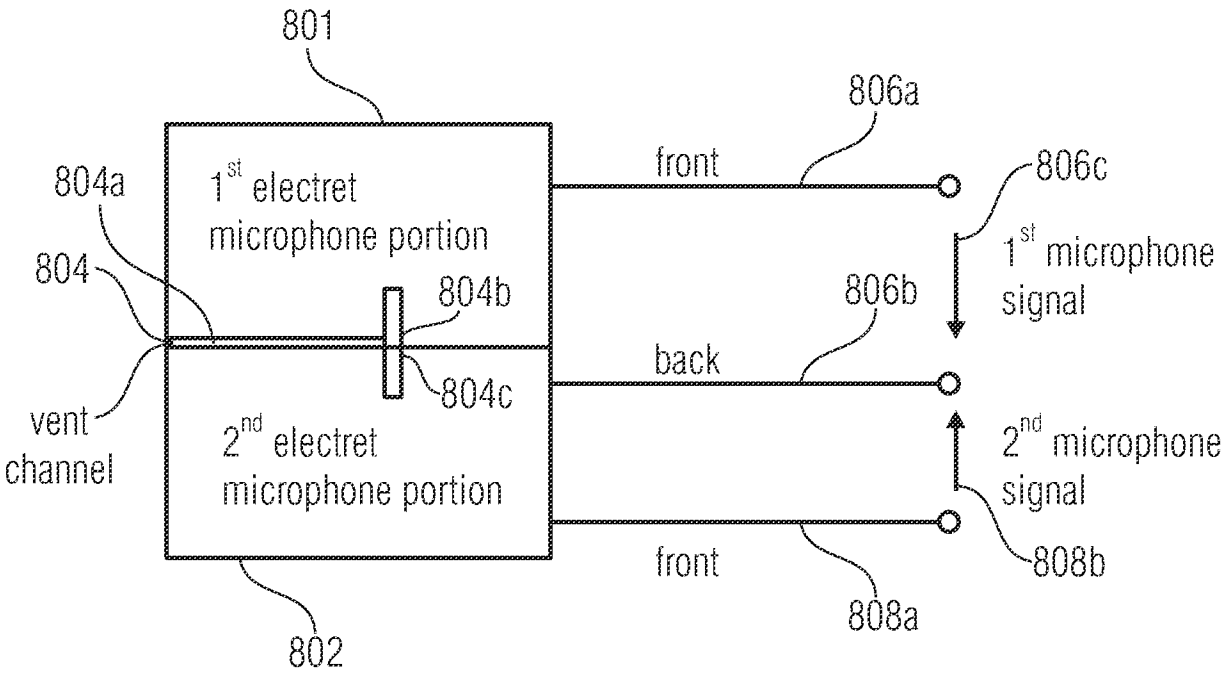
FIG. 8 illustrates the schematic representation of a microphone.

The microphone comprises a first electret microphone portion 801 having a first free space and a second electret portion 802 having a second free space. The first and the second microphone portions 801, 802 are arranged in a back-to-back arrangement. Furthermore, a vent channel 804 is provided for venting the first free space and/or the second free space. Furthermore, first contacts 806*a*, 806*b* for deriving an electrical signal 806*c* and second contacts 808*a* and 806*b* for deriving a second electrical signal 808*b* are arranged at the first microphone portion 801, and the second microphone portion 802, respectively. Hence, FIG. 8 illustrates a vented back-to-back electret microphone arrangement. Advantageously, the vent channel 804 comprises two individual vertical vent channel portions 804*b*, 804*c*, which communicate with a horizontal vent channel portion 804*a*. This arrangement allows that the vent channel is produced within corresponding counter electrodes or microphone backsides before the individually produced first and second microphone portions 801, 802 are stacked on each other.

Figure 10:
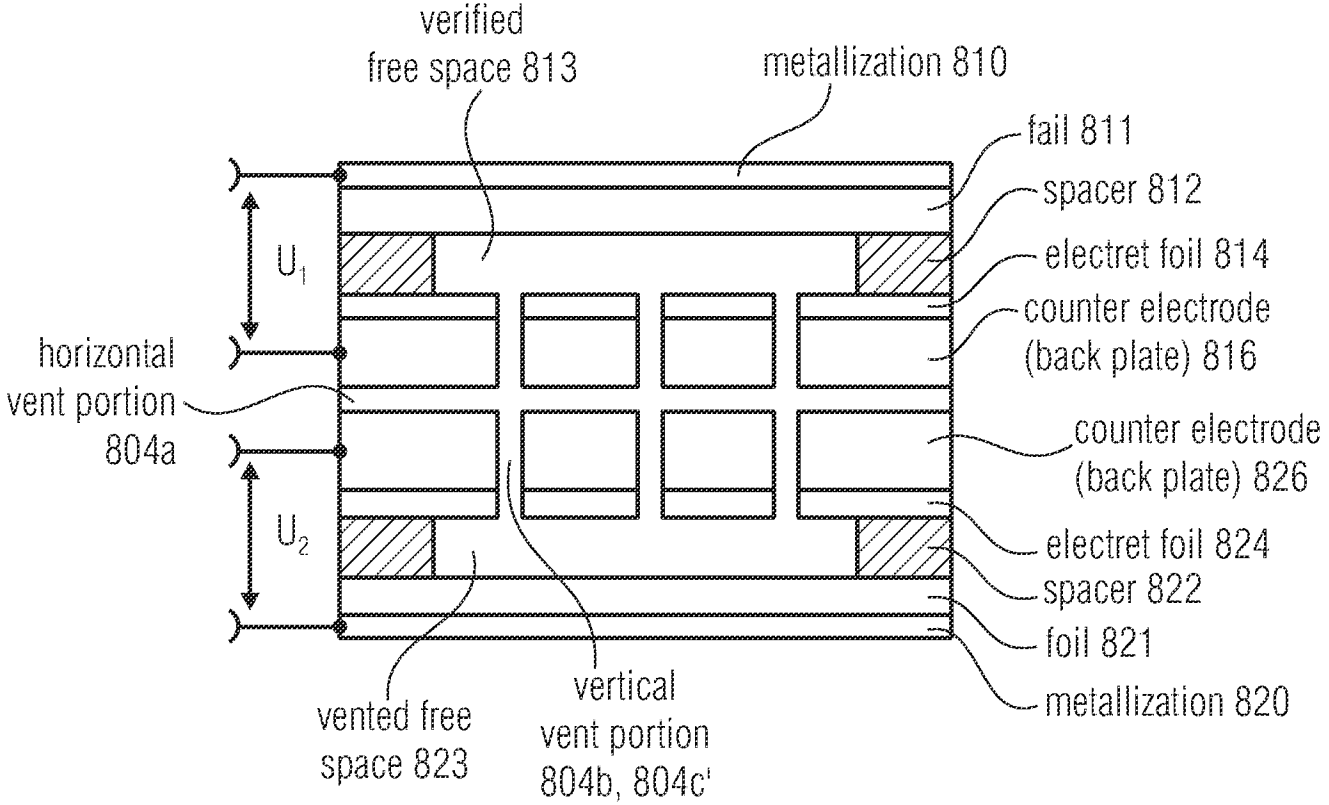
FIG. 10 illustrates a detailed implementation of a microphone.

FIG. 10 illustrates a cross-section through a microphone implemented in accordance with the principles illustrated in FIG. 8. Advantageously, the first electret microphone portion 801 comprises, from top to bottom in FIG. 10 a first metallization 810 on a foil 811 which is placed on top of a spacer 812. The spacer defines the first vented free space 813 of the first microphone portion 801. The spacer 812 is placed on top of an electret foil 814 which is placed on a counter electrode or "back plate" indicated at 816. Elements 810, 811, 812, 813, 814 and 816 define the first electret microphone portion 801.

The second electret microphone portion 802 is advantageously constructed in the same manner and comprises, from bottom to top, a metallization 820, a foil 821, a spacer 822 defining a second vented free space 823. On the spacer 822 an electret foil 824 is placed and above the electret foil 824 a counter electrode 826 is placed which forms the back plate of the second microphone portion. Hence, elements 820 to 826 represent the second electret microphone portion 802 of the FIG. 8 in an embodiment.

Advantageously, the first and the second microphone portions have a plurality of vertical vent portions 804*b*, 804*c*, as illustrated in FIG. 10. The number and arrangement of the vertical vent portions over the area of the microphone portions can be selected depending on the needs. However, it is advantageous to use an even distribution of the vertical vent portions over the area as illustrated in FIG. 10 in a cross-section. Furthermore, the horizontal vent portion 804*a* is indicated in FIG. 10 as well, and the horizontal vent portion is arranged so that it communicates with the vertical vent portions, connects the vertical vent portions and therefore connects the vented free spaces 813, 823 to the ambient pressure so that irrespective of any movement of the electrodes formed by the metallization 810 and the foil 811 of the upper microphone or the movement of the movable electrode formed by the metallization 820, 821 for the lower microphone is not damped by a closed free space or so. Instead, when the membrane moves, then a pressure equalization is obtained by the vertical and horizontal vent portions 804*a* to 804*c*.

Advantageously, the microphone in accordance with the present invention is a back-electret double-microphone with a symmetrical construction. The metalized foils 811, 821 are moved or excited by the kinetic energy of the air molecules (sound) and therefore the capacity of the capacitor consisting of the back electrode 816, 826 and the metallization 810, 820 is changed. Due to the persistent charge on the electret foils 814, 824, a voltage $U_1$, $U_2$ is generated due to the equation $Q=C\times U$, which means that U is equal to Q/C. The voltage $U_1$ is proportional to the movement of the electrode 810, 811, and the voltage $U_2$ is proportional to the movement of the electrode 820, 821. Two individual electret microphones are arranged in a back-to-back arrangement. The vertical vent portions 804*b*, 804*c* are useful in order to avoid a back-like closure of the free spaces 813, 823. In order to maintain this functionality additionally when the microphones are arranged in the back-to-back arrangement, the horizontal vent portions 804*a* are provided which communicate with the vertical vent portions 804*b*, 804*c*. Hence, even in the back-to-back arrangement, a closure of the vented free spaces 813, 823 is avoided.

Figure 9:
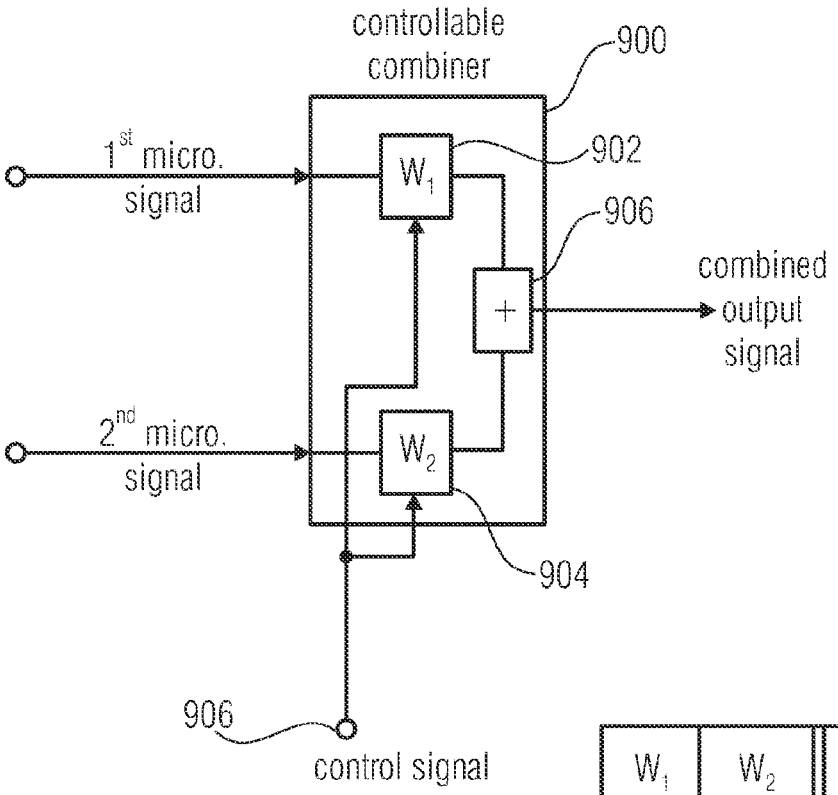
FIG. 9 illustrates a schematic representation of a controllable combiner useful in combination with the back-to-back electret microphone of FIG. 8.

FIG. 9 illustrates a controllable signal combiner 900, which receives the first microphone signal from the first microphone portion and the second microphone portion from the second microphone portion. The microphone signals can be voltages. Furthermore, the controllable combiner 900 comprises the first weighting stage 902 and/or a second weighting stage 904. Each weighting stage is configured for applying a certain weighting factor $W_1$, $W_2$ to the corresponding microphone signal. The output of the weighting stages 902, 904 are provided to an adder 906, which adds the output of the weighting stages 902, 904 to produce the combined output signal. Furthermore, the controllable combiner 900 advantageously comprises a control signal 908 which is connected to the weighting stages 902, 904 in order to set the weighting factors depending on a command applied to the control signal. FIG. 9 additionally illustrates a table, where individual weighting factors are applied to the microphone signals and where it is outlined which characteristic is obtained in the combined output signal. It becomes clear from the table in FIG. 9 that when an in-phase addition of both microphone channels or microphone signals is performed, i.e. when the weighters 902, 904 are not provided at all or have the same weighting factor 1 or −1, then an omnidirectional characteristic of the back-to-back electret microphone arrangement is obtained. However, when an out-of-phase addition is performed as indicated by weighting factors having a different sign, then a figure of eight characteristic is obtained. Arbitrarily designed cardioid-like characteristics can be obtained by different level settings and out-of-phase additions, i.e. different weighting factors and weighting factors different from one instructed by a corresponding control signal at control input 906.

Naturally, an actually provided signal combiner does not necessarily have to be the controllability feature. Instead, the in-phase, out-of-phase or weighted addition functionality of the combiner can be correspondingly hardwired so that each microphone has a certain output signal characteristic with the combined C output signal, but this microphone cannot be configured. However, when the controllable combiner has the switching functionality illustrated in FIG. 9, then a configurable microphone is obtained where a basic configurability can for example be obtained by only having one of the two weighters 902, 904 where this weighter, when correspondingly controlled, performs an inversion to obtain the out-of-phase addition, while when the two input signals are simply added by the adder 906 an in-phase addition is obtained.

Figure 11:
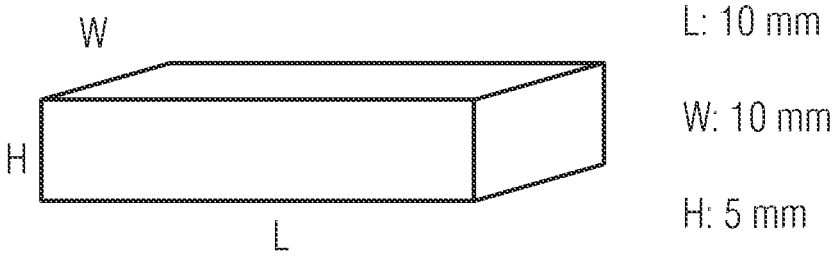
FIG. 11 illustrates the outer form of the microphone of FIG. 10.
Figure 12:
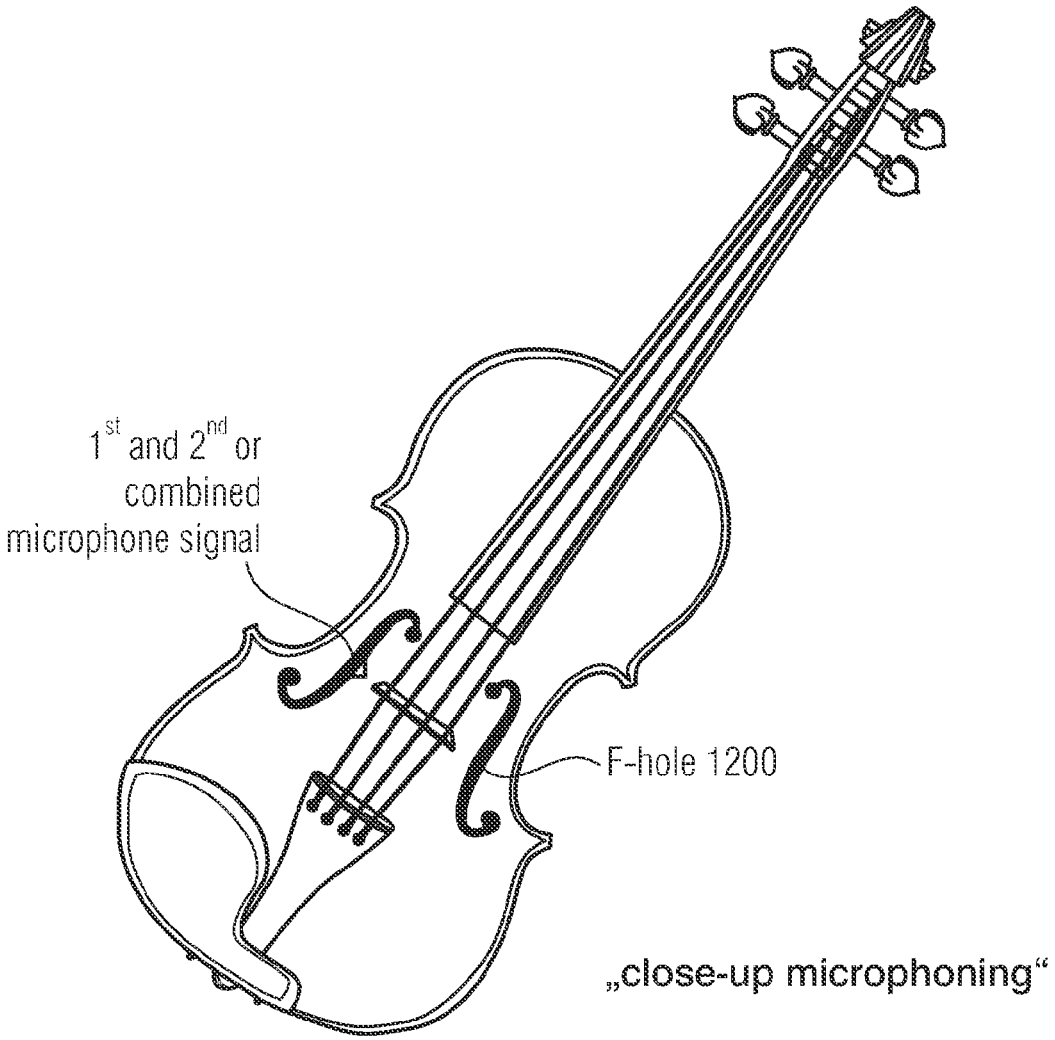
FIG. 12 illustrates a violin having a microphone attached to the F-hole.

Advantageously, the inventive electret microphone is miniaturized and only has dimensions as are set forth in FIG. 11. Advantageously, the length dimension is lower than 20 mm and even equal to 10 mm. Furthermore, the width dimension is advantageously lower than 20 mm and even equal to 10 mm, and the height dimension is lower than 10 mm and even equal to 5 mm. The present invention allows to produce miniaturized double microphones which use the electret technology which can advantageously be placed at critical places such as F-holes of a violin and so forth as illustrated in FIG. 12. FIG. 12 particularly illustrates a violin with two F-holes 1200, where in one F-hole 1200 a microphone as illustrated in FIG. 8 is placed. If the microphone does not have the signal combiner, then the first and the second microphone signals can be output by the microphone or if the microphone has the combiner, the combined output signal is output. The output can take place via a wireless or wired connection. The transmitter for the wireless connection does not necessarily have to be placed within the F-hole as well, but can be placed at any other suitable place of the violin. Hence, as indicated in FIG. 12 a close-up microphoning of acoustical instruments can be realized.

Furthermore, in order to fully detect the vibration energy, the icon microphone should have an audio bandwidth of 60 kHz and advantageously up to 100 kHz. To this end, the foils 811, 821 have to be attached to the spacer in a correspondingly stiff manner. The microphone illustrated in FIG. 8 is useful for transmitting the translation energy portion, the rotation energy portion and the vibration energy portion in accordance with the icon criteria. In contrast to conventional technologies, where only condenser microphones exist for this purpose, the inventive electret microphone is considerably smaller and therefore considerably more useful when it comes to flexibility regarding placement and so on. The sound acquisition, sound transmission and sound generation in accordance with the present invention and as performed in accordance with inventive microphone technology and inventive loudspeaker technology results in a substantially more nature-like rendering of particularly acoustical instruments and the human voice. The often heard complaints about a "speaker sound" are no longer pertinent, since the inventive concept results in a sound rendering without the typical "speaker sound". Furthermore, the usage of sound transducers with enhanced frequency ranges at the acquisition stage and at the sound reproduction stage results in an enhanced reproduction of the original sound source. Specifically, the liveliness of the original sound source and the entire sensational intensity of the reproduction are considerably enhanced. Listening tests have shown that the inventive concept results in a much more comfortable sound experience. Furthermore, listening tests have shown that the sound level when reproducing translation, rotation and vibration can be reduced by up to 10 dB compared to the sound level of conventional systems only rendering translational sound energy without having a subjective loss of loudness perception. The reduction of the sound level additionally results in a reduced power consumption which is particularly useful for portable devices and additionally the danger of damages to the human hearing system is considerably reduced.

Although some aspects have been described in the context of an apparatus, it is clear that these aspects also represent a description of the corresponding method, where a block or device corresponds to a method step or a feature of a method step. Analogously, aspects described in the context of a method step also represent a description of a corresponding block or item or feature of a corresponding apparatus.

Depending on certain implementation requirements, embodiments of the invention can be implemented in hardware or in software. The implementation can be performed using a digital storage medium, for example a floppy disk, a DVD, a CD, a ROM, a PROM, an EPROM, an EEPROM or a FLASH memory, having electronically readable control signals stored thereon, which cooperate (or are capable of cooperating) with a programmable computer system such that the respective method is performed.

Some embodiments according to the invention comprise a non-transitory data carrier having electronically readable control signals, which are capable of cooperating with a programmable computer system, such that one of the methods described herein is performed or having stored thereon the first or second acquisition signals or first or second mixed signals.

Generally, embodiments of the present invention can be implemented as a computer program product with a program code, the program code being operative for performing one of the methods when the computer program product runs on a computer. The program code may for example be stored on a machine readable carrier.

Other embodiments comprise the computer program for performing one of the methods described herein, stored on a machine readable carrier.

In other words, an embodiment of the inventive method is, therefore, a computer program having a program code for performing one of the methods described herein, when the computer program runs on a computer.

A further embodiment of the inventive methods is, therefore, a data carrier (or a digital storage medium, or a computer-readable medium) comprising, recorded thereon, the computer program for performing one of the methods described herein.

A further embodiment of the inventive method is, therefore, a data stream or a sequence of signals representing the computer program for performing one of the methods described herein. The data stream or the sequence of signals may for example be configured to be transferred via a data communication connection, for example via the Internet.

A further embodiment comprises a processing means, for example a computer, or a programmable logic device, configured to or adapted to perform one of the methods described herein.

A further embodiment comprises a computer having installed thereon the computer program for performing one of the methods described herein.

In some embodiments, a programmable logic device (for example a field programmable gate array) may be used to perform some or all of the functionalities of the methods described herein. In some embodiments, a field programmable gate array may cooperate with a microprocessor in order to perform one of the methods described herein. Generally, the methods are performed by any hardware apparatus.

While this invention has been described in terms of several advantageous embodiments, there are alterations, permutations, and equivalents which fall within the scope of this invention. It should also be noted that there are many alternative ways of implementing the methods and compositions of the present invention. It is therefore intended that the following appended claims be interpreted as including all such alterations, permutations, and equivalents as fall within the true spirit and scope of the present invention.

The invention claimed is:

1. A loudspeaker, comprising:

a longitudinal enclosure comprising at least one subwoofer speaker for emitting lower sound frequencies, wherein a length of the longitudinal enclosure is greater than a lateral dimension of the longitudinal enclosure;

a carrier portion on top of the longitudinal enclosure; and a speaker arrangement comprising individual speakers for emitting higher sound frequencies arranged in a different direction with respect to the longitudinal enclosure, wherein the speaker arrangement is fixed to the carrier portion and is not surrounded by the longitudinal enclosure, wherein the speaker arrangement does not comprise a loudspeaker enclosure and wherein the individual speakers are held by a supporting structure designed so that membranes of the individual speakers are freely vibratable and so that rotational energy is generatable, and wherein the carrier portion comprises a base portion comprising the same matching dimensions with the longitudinal enclosure and a tip portion comprising a cross-section area being less than 20% of a cross-section of the base portion, and wherein the speaker arrangement is fixed to the tip portion only.

2. Loudspeaker of claim 1, wherein the length of the longitudinal enclosure is greater than 50 cm and the lateral dimension is greater than 20 cm.

3. Loudspeaker of claim 1, wherein the longitudinal enclosure is a cylindrical enclosure, wherein a cross-section of the cylindrical enclosure is similar to a circle.

4. Loudspeaker of claim 1, wherein the supporting structure is sphere-like, and wherein the membranes of the individual speakers are attached so that each membrane emits in a different direction.

5. Loudspeaker of claim 1, wherein the speaker arrangement comprises at least six individual speakers.

6. Loudspeaker of claim 1, wherein the speaker arrangement comprises a pentagonal dodekaeder comprising twelve individual areas wherein an individual speaker is placed at each individual area.

7. Loudspeaker of claim 1, wherein the supporting structure is configured for collectively supporting all individual speakers, wherein each individual speaker comprises a membrane and does not comprise an individual speaker case.

8. Loudspeaker of claim 7, wherein the supporting structure comprises a plurality of holes in addition to the places, wherein the loudspeaker membranes are fixed to support an air circulation between an inside of the supporting structure and an outside of the supporting structure so that the membranes are freely vibratable with no damping due to a room within the supporting structure surrounded by the individual speaker membranes.

9. Loudspeaker of claim 1, wherein the longitudinal enclosure furthermore comprises an electronic module for feeding the subwoofer speaker and the speakers in the speaker arrangement.

10. Loudspeaker of claim 1, wherein the longitudinal enclosure is closed by a top portion to which the carrier portion is attached and by a base portion.

11. Loudspeaker of claim 1, wherein the subwoofer speaker is fixed in an inside of the longitudinal enclosure and directed to the carrier portion to emit the sound waves to the top and the bottom of the longitudinal enclosure.

12. Loudspeaker of claim 1, wherein the longitudinal enclosure further comprises at least one further speaker, wherein the further speaker is fed by a loudspeaker signal being different from the loudspeaker signal fed to the individual speakers in the speaker arrangement.

13. Loudspeaker of claim 1, wherein there are two more further speakers located at the longitudinal enclosure, and wherein the speakers are arranged only at places of the longitudinal enclosure directed to a listener, when the loudspeaker is in an operating position to acquire a directed sound emission in addition to a non-directed or less-directed sound emission acquired by the speaker arrangement.

14. Loudspeaker of claim 1, wherein the subwoofer comprises two or more further speakers located at the longitudinal enclosure, and wherein a low/mid speaker is arranged at an upper portion of the enclosure, and wherein the low/mid speaker is attached within the longitudinal enclosure such that a membrane of the low/mid speaker is freely suspended, whereby rotational energy is generated in the low/mid frequency range.

15. Method of manufacturing a loudspeaker, comprising:

fixing a carrier portion on top of a longitudinal enclosure comprising at least one subwoofer speaker for emitting lower sound frequencies, wherein a length of the longitudinal enclosure is greater than a lateral dimension of the longitudinal enclosure; and fixing a speaker arrangement on top of the carrier portion, the speaker arrangement comprising individual speakers for emitting higher sound frequencies arranged in a different direction with respect to the longitudinal enclosure, wherein the speaker arrangement is fixed to the carrier portion and is not surrounded by the longitudinal enclosure, wherein the loudspeaker arrangement does not comprise a loudspeaker enclosure and wherein the individual speakers are held by a supporting structure designed so that membranes of the individual speakers are freely vibratable and so that rotational energy is generatable, and wherein the carrier portion comprises a base portion comprising the same matching dimensions with the longitudinal enclosure and a tip portion comprising a cross-section area being less than 20% of a cross-section of the base portion, and wherein the speaker arrangement is fixed to the tip portion only.

* * * * *